United States Patent [19]

D'Souza et al.

[11] Patent Number: 5,042,583

[45] Date of Patent: Aug. 27, 1991

[54] STEAM FOAM DRIVE METHOD FOR ENHANCED OIL RECOVERY

[75] Inventors: Adrian D'Souza, Walnut Creek; Francois Friedmann, Manhattan Beach, both of Calif.

[73] Assignee: Chevron Research and Technology Company, San Francisco, Calif.

[21] Appl. No.: 604,034

[22] Filed: Oct. 25, 1990

Related U.S. Application Data

[63] Continuation of Ser. No. 292,200, Dec. 30, 1988, abandoned.

[51] Int. Cl.[5] ..... E21B 43/22; E21B 43/24

[52] U.S. Cl. ..... 166/272; 166/273; 166/309

[58] Field of Search ..... 166/57, 272, 273, 274, 166/302, 303, 309

[56] References Cited

U.S. PATENT DOCUMENTS

| | | | |
|---|---|---|---|
| 3,353,593 | 11/1967 | Boberg | 166/272 X |
| 3,421,583 | 1/1969 | Koons | 166/269 |
| 3,476,183 | 11/1969 | Haynes, Jr. et al. | 166/272 |
| 3,537,526 | 11/1970 | Offeringa | 166/272 X |
| 3,581,822 | 6/1971 | Cornelius | 166/272 X |
| 4,085,800 | 4/1978 | Engle et al. | 166/272 X |
| 4,445,573 | 5/1984 | McCaleb | 166/272 X |
| 4,470,462 | 9/1984 | Hutchison | 166/272 X |
| 4,488,598 | 12/1984 | Duerksen | 166/272 X |
| 4,852,653 | 8/1989 | Borchardt | 166/272 |

*Primary Examiner*—George A. Suchfield

*Attorney, Agent, or Firm*—T. G. DeJonghe; C. J. Caroli

[57] ABSTRACT

A process for the recovery of oil from a petroleum reservoir by improving steam sweep efficiency during steam-flooding, wherein a foaming agent is added to divert steam to unswept zones and the reservoir is penetrated by at least one injection well and at least one production well, which process comprises injecting steam and a surfactant solution into an injection well, while concurrently and separately injecting an additional amount of liquid water into the injection well; and recovering oil from a production well.

13 Claims, No Drawings

STEAM FOAM DRIVE METHOD FOR ENHANCED OIL RECOVERY

CROSS-REFERENCE TO RELATED APPLICATIONS

This application is a continuation of application Ser. No. 292,200, filed Dec. 30, 1988, now abandoned.

BACKGROUND OF THE INVENTION

This invention relates to a method of recovering crude petroleum from subsurface earth formations. More particularly, this invention relates to a method for improving a steam foam diversion process to increase the steam sweep efficiency during steam-flooding for the recovery of oil from an underground formation.

Many hydrocarbons are too thick to be recovered from subterranean petroleum-containing formations without assistance. These hydrocarbons are either the residual oil left in a depleted reservoir or virgin heavy hydrocarbons. These heavy hydrocarbons can be recovered through the use of steam drives which heat the formation, lower the viscosity of the hydrocarbons and enhance the flow of the hydrocarbons toward a production well.

However, it is commonly found that the steam will find shortcut pathways to some of the producing wells, thus bypassing oil in the zone between the injection well and the production well. Also, after initial steam injection breakthrough at the production well, the steam injection preferentially follows the path of the breakthrough. These pathways can take the form of channels in the formation or of gravity override in the upper portion of the oil-bearing stratum. Gravity override results from the lower density and viscosity of steam vapor compared to liquid oil and water. Thus, the total amount of the formation that is swept by the steam injection is limited.

Various methods have been proposed to mitigate the loss of steam flow and heating value within the formation. For example, a number of commercial surfactants have been injected along with steam to create a steam-foam flood. The surfactants form a foam that inhibits the flow of the steam into that portion of the formation containing only residual oil saturation and serves to physically block the volumes through which steam is short-cutting. This forces the steam to drive the recoverable hydrocarbons from the less depleted portions of the reservoir toward the production well.

In addition, various inert or noncondensable gases have been added to the steam, both in the presence and absence of foaming surfactants, in order to enhance and maintain an oil-driving force within the formation.

For example, in U.S. Pat. No. 3,908,762, a complex steam injection process is described which employs a mixture of steam and a noncondensable gas. In this patent, the improvement is primarily based upon the disclosure that the noncondensable gas may include nitrogen, air, carbon dioxide, flue gas, exhaust gas, methane, natural gas and ethane.

U.S. Pat. No. 4,086,964 to Dilgren et al. describes the use of a foam-forming mixture of steam, noncondensable gas and surfactant injected into a steam channel in an oil reservoir in which stratification of the rock permeability is insufficient to confine steam within the permeable strata. The noncondensable gas which is added to the foam and steam is in very low concentration to stabilize the foam. The gas is included in fractions of a mole percent in the foam and the foam is intended to resist the flow of steam through the oil-depleted zone, thereby diverting the steam into undepleted zones.

U.S. Pat. No. 4,445,573 to McCaleb discloses a method for recovering oil from a subterranean oil-bearing reservoir by steam stimulation, wherein the reservoir includes a permeable zone and an oil-bearing strata, utilizing a mixture of noncondensable gas and surfactant which forms a relatively stable, substantially noncondensable, thermally insulating foam having the noncondensable gas as a gas phase. This noncondensable, thermally insulating foam is injected into the reservoir to substantially fill an expanse of the permeable zone in proximity with the portion of the oil-bearing strata to be stimulated.

U.S. Pat. No. 4,393,937 to Dilgren et al. discloses a steam foam drive process for displacing oil within a subterranean reservoir which utilizes a steam-foam-forming mixture of steam having a quality of 10 to 90 percent, and preferably 30 to 80 percent, an olefin sulfonate surfactant, an electrolyte and a noncondensable gas present in an amount between about 0.0003 and 0.3 mole percent of the gas phase of the mixture.

U.S. Pat. No. 4,161,217 to Dilgren et al. discloses a process for recovering oil from a subterranean reservoir by establishing a channel of preferential permeability through the reservoir between injection and production locations, then flowing through the reservoir a hot foam of aqueous liquid, noncondensable gas and surfactant, and controlling the mobility of the foam so that heated oil is produced and hot fluid is flowed through portions of the reservoir within and outside the channel of preferential permeability.

U.S. Pat. No. 4,085,800 to Engle et al. discloses a process for plugging a permeable strata in subterranean oil-bearing formations wherein a hot, noncondensable gas is used to preheat a portion of the permeable strata to a temperature above the boiling point of water at operating pressure. A mixture of steam and a surfactant is then introduced into the preheated portion of the permeable strata and allowed to form a foam, thereby plugging the permeable strata. Once the desired portion of the permeable strata is plugged, steam alone, without a surfactant, is utilized for stimulating production of oil from less permeable strata.

Demonstration of the ability of a surfactant to form a useful foam at steamflood conditions is commonly done by a laboratory coreflood. In this procedure, a cylindrical core of sandstone of relatively high permeability is encased in a pressure tight holder and fitted with means for passing gases and liquids through it. The usual instruments to record flow rates, temperatures, and pressure drop across the core allow measurements of resistance to flow to be made under simulated oil field reservoir conditions. A standard measure of the suitability of a surfactant to divert steam flow is the "Resistance Factor" (RF). The Resistance Factor is defined as the ratio of resistance to flow using steam and a surfactant compared to steam alone, i.e., the ratio of the pressure drops across the core under the two conditions. The higher the value of RF, the more effective the surfactant under a given set of conditions.

In the Society of Petroleum Engineers paper No. SPE 16375 (April, 1987) entitled "Physical and Chemical Effects of an Oil Phase on the Propagation of Foam in Porous Media", J. A. Jensen and F. Friedmann teach that RF values in laboratory cores decrease significantly when steam quality is decreased. The data in this paper also show that RF values increase with the injection of nitrogen.

Society of Petroleum Engineers paper No. SPE 13609 (March, 1985) entitled "Two Successful Steam-Foam Field Tests, Sections 15A and 26C, Midway-Sunset Field" by J. F. Ploeg and J. H. Duerksen and paper No. SPE 16736 (Sept., 1987) entitled "Steam-Foam Pilot Project in Dome Tumbador, Midway-Sunset Field" by S S. Mohammadi et al. disclose oil field steam-foam applications using 24 and 18 standard cubic feet of nitrogen gas per cold water equivalent barrel of steam injected, respectively.

In view of the foregoing, it can be seen that it is known in the art to combine the heating of a reservoir with steam to increase the mobility of crude oil therein with the injection of foamable surfactant and small amounts of noncondensable gas to improve the sweep efficiency of the steam within the reservoir. There is a need, however, to provide a practical means to accomplish these goals more efficiently.

SUMMARY OF THE INVENTION

The present invention provides a process for the recovery of oil from a petroleum reservoir by improving steam sweep efficiency during steam-flooding, wherein a foaming agent is added to divert steam to unswept zones and the reservoir is penetrated by at least one injection well and at least one production well, which comprises a. injecting steam and a surfactant solution into an injection well, while concurrently and separately injecting an additional amount of liquid water into the injection well; and b. recovering oil from a production well.

In a preferred embodiment, the present invention further relates to a process for the recovery of oil from a petroleum reservoir by improving steam sweep efficiency during steam-flooding, wherein a foaming agent is added to divert steam to unswept zones and the reservoir is penetrated by at least one injection well and at least one production well, which comprises a. continuously injecting a mixture of steam, noncondensable gas and a surfactant solution, while concurrently and separately injecting an additional amount of liquid water, into an injection well at rates sufficient to achieve a downhole liquid volume fraction greater than 0.008, until an elevated pressure is obtained at the injection wellhead;

b. thereafter continuously injecting steam into the injection well, while slug injecting a noncondensable gas, a surfactant solution, and an additional amount of liquid water at rates sufficient to achieve a liquid volume fraction greater than 0.008, until an elevated pressure is obtained at the injection wellhead; and c. recovering oil from a production well.

Among other factors, the present invention is based on the discovery that a rapid foam response and consequently, an enhanced sweep efficiency, can be obtained in a steam foam oil recovery process by providing a rapid pressure increase at the injection wellhead and maintaining a downhole liquid volume fraction greater than 0.008. Enhancing the sweep efficiency of steam through the reservoir formation results in enhanced recovery of oil at the production well.

DETAILED DESCRIPTION OF THE INVENTION

In a steam drive oil recovery process, the liquid volume fraction, or LVF, is defined as the ratio of the volume occupied by steam in the liquid phase to the total volume occupied by the liquid and vapor phases of the injected steam at downhole conditions.

By comparison, steam quality is defined as the weight percent of steam present in the vapor phase in the two-phase (liquid plus vapor) steam that is injected. In steam drive operations, the quality of the injected steam will generally vary from about 50 to 80 percent, with a typical range being about 60 to 65 percent. Since the vapor phase occupies so much volume relative to the liquid phase, steam of 50 to 80 percent quality will result in liquid volume fractions in the range of about 0.001 to 0.005, or 0.1 to 0.5 percent by volume of liquid in the injected steam. As steam quality measures the weight quantity of steam in the vapor phase, higher steam qualities correspond to lower liquid volume fractions.

In any steam-foam operation, the generation of foam necessarily requires the presence of sufficient liquid for the formation of foam bubbles. Thus, the higher the liquid volume fraction, the easier it becomes to generate foam. However, a high steam quality is also required in order to adequately heat the viscous hydrocarbons in the reservoir. As a result, the relatively high steam quality employed in typical steam drives results in a liquid volume fraction below about 0.008, which has now been found to be too low for the formation and maintenance of adequate foam.

The present invention solves the problem of insufficient liquid volume content for foam formation by providing a steam foam oil recovery process which generates a rapid foam response, as measured by a rapid pressure increase, by maintaining a liquid volume fraction greater than 0.008 at steam qualities greater than 50%. This rapid pressure increase results in improved sweep efficiency and enhanced recovery of oil at the production well. Preferably, the liquid volume fraction will be maintained in the range of about 0.010 to about 0.050, and more preferably, about 0.010 to about 0.015.

Various means can be employed to increase the downhole liquid volume fraction and maintain it at a level greater than about 0.008. For example, a reduction in the injected steam quality will result in a corresponding increase in the liquid volume fraction. However, a reduction in steam quality has the disadvantage of reducing the heat input into the reservoir. Thus, in a typical steam drive operation, it has been found that decreasing the steam quality by about 20% will increase the liquid volume fraction by about 50 percent but will also decrease the reservoir heat input by about 20 percent. Consequently, steam quality reduction is not an efficient means of increasing liquid volume fraction.

It has now been discovered that a surprisingly efficient method for increasing the downhole liquid volume fraction involves the use of water injection at the steam injector wellhead where foam is being applied. Accordingly, it has now been found that adding liquid water to the steam fed to the injection well in a quantity up to about 30 percent of the steam flow (as measured in cold water equivalents) achieves a 50 percent increase in liquid volume fraction, when the LVF value is below about 0.008, while decreasing the reservoir heat input by only about 6 percent. Water injection is more efficient than steam quality reduction because steam quality reduction reduces the amount of vapor flowing into the reservoir, and it is the vapor phase of the steam that contributes about 80 percent of the injected reservoir heat. By comparison, adding water at the wellhead only reduces heat input to the reservoir by the amount of sensible heat required to heat up the injector water to injection temperatures.

The additional liquid water can be added separately from the surfactant solution, although it is injected at the same time, that is, concurrently with the surfactant. This additional water can conveniently be added by a separate injection line. The additional water can, of course, also be added into the steam injection line, which is a preferred method of operation. The additional water can also be injected into the surfactant solution injection line, with or without an in line mixer. The term "separately injecting an additional amount of liquid water", as used herein, is meant to include the above-described injection into the steam line or the surfactant injection line. The additional amount of liquid water is to be differentiated from and does not include the water already present in the surfactant solution or in the liquid phase of the steam. Note that the amount of water present in the surfactant solution is too small a quantity to alter the liquid volume fraction of the injected steam. Therefore, the additional injection of liquid water is necessary to increase the liquid volume fraction to the desired levels.

Typically, in industrial practice, steam generators feed multiple injectors, only some of which would require foam injection to correct problems associated with steam breakthrough. Lowering steam quality is, therefore, an uneconomical way of elevating the liquid volume fraction, as it will also reduce heat input to injectors where foam is not being employed.

As a result, the use of water injection at the steam injector wellhead is preferable to steam quality reduction in order to increase the liquid volume fraction to values above about 0.008.

Water injection therefore enhances the foaming process, thereby increasing the pressure at the steam injector well. It should be noted that the most efficient way to increase liquid volume fraction without causing any reduction in heat input to the reservoir is to provide the rapid pressure increase at the injection well. A rapid pressure increase causes the vapor phase to compress, thus lowering the vapor volume. Since the liquid phase is relatively incompressible, an increase in pressure results in a further increase in the liquid volume fraction.

A rapid pressure increase at the injection well can be achieved by the continuous injection of a high concentration of foamable surfactant along with the steam during an initial period of injection. This initial period of continuous injection should be carried out until an elevated pressure is reached. Typically, this elevated pressure fluctuates within a relatively narrow range, while maintaining a substantially steady level of elevated pressure.

Once an elevated pressure is achieved, the concentration of foamable surfactant can be decreased by about 25 to 75 percent and, while continuously injecting steam, the surfactant is slug injected at a rate sufficient to maintain the pressure at its elevated level.

The term "slug injection" encompasses a variety of situations where surfactant addition is interrupted over time. Slug injection includes procedures such as continuous injection of surfactant for 24 to 48 hours straight per week as well as injection for a portion of each day for a period that may extend for weeks or months.

For example, preferred methods of slug injection include 12 hours on followed by 12 hours off for 5 days a week, or 8 hours per day for 5 to 7 days a week, or 2 days on followed by 2 days off. Preferably, surfactant is injected intermittently for about 40 to 100 hours per week, preferably for about 50 to 80 hours per week.

In addition, a rapid pressure increase can be facilitated by injecting unusually large quantities of noncondensable gas along with the steam and foamable surfactant. In conventional steam-foam operations, noncondensable gases have been employed in small amounts, typically 18 to 24 standard cubic feet per barrel cold water equivalent of injected steam, to initiate foaming and to stabilize the foam being generated. It has now been found that injecting a noncondensable gas at about two to five times the rates previously employed in conventional steam-foam drive operations results in a rapid pressure increase, which in turn can be utilized to elevate the liquid volume fraction to values greater than 0.008.

Accordingly, in a preferred mode of operation, the present invention provides a process for the recovery of oil from a petroleum reservoir by improving steam sweep efficiency during steam-flooding, wherein a foaming agent is added to divert steam to unswept zones and the reservoir is penetrated by at least one injection well and at least one production well, which comprises a. continuously injecting a mixture of steam, noncondensable gas and a surfactant solution, while concurrently and separately injecting an additional amount of liquid water, into an injection well at rates sufficient to achieve a downhole liquid volume fraction greater than 0.008, until an elevated pressure is obtained at the injection wellhead;

b. thereafter continuously injecting steam into the injection well, while slug injecting a noncondensable gas, a surfactant solution, and an additional amount of liquid water at rates sufficient to achieve a liquid volume fraction greater than 0.008, until an elevated pressure is obtained at the injection wellhead; and c. recovering oil from a production well.

In step a, above, the noncondensable gas injection rate will generally range from about 35 to 120, and preferably about 50 to 100 standard cubic feet per barrel of cold water equivalent (CWE) steam injected.

Furthermore, the surfactant injection concentration in step a, above, will normally range from about 0.2 to 1.0, and preferably about 0.5 to 1.0, weight percent of the liquid phase of injected fluid ( water injected plus liquid phase of steam).

In step b, above, it has been found that the noncondensable gas and surfactant can each be slug injected at individual rates ranging from about 25 to 100 percent of the rates of injection used in step a.

In general, the continuous injection employed in step a should be carried out for a period of at least one week, although longer periods of time are also contemplated. In some operations, a period of less than one week may be sufficient to reach a steady elevated pressure.

In step b, the slug injection of surfactant and noncondensable gas will generally be carried out over a period of up to seven consecutive days per week for a period of at least one week. Of course, this time frame can be varied, depending on individual operating conditions.

Typically, slug injection will continue for a period of about 4 to 6 months.

In order to provide an enhanced sweep efficiency, it has been found that the liquid volume fraction in steps a and b, above, should be maintained at levels greater than about 0.008, preferably at levels in the range of about 0.010 to about 0.050, and more preferably, from about 0.010 to about 0.015.

Additional water in the liquid phase is injected into the injection well in both step a and step b, above, at a rate sufficient to maintain the liquid volume fraction at a value greater than about 0.008. Preferably, the additional water will be injected in a quantity between about 1 and 30 percent of the amount of cold water equivalent steam injected. This additional water is injected into the injection well simultaneously with, and separately from, the injection of surfactant.

The surfactant employed in the present invention will preferably be one of a number of commercially available surfactants known in the art of steam foam diversion. Examples of such surfactants include alpha olefin sulfonates, alpha olefin sulfonate dimers, and surfactants such as various alkylaromatic sulfonates. Mixtures of surfactants are also contemplated.

The noncondensable gas employed in the process of the invention may be any of the noncondensable gases known in the art to be useful for steam drive operations. Examples of such noncondensable gases include nitrogen, air, carbon dioxide, flue gas and hydrocarbon gas, such as methane, ethane, propane, butane, and any other hydrocarbons that are gaseous at steamflood conditions. A preferred noncondensable gas is nitrogen. Mixtures of noncondensable gas may also be employed.

The following examples are provided to illustrate the invention in accordance with the principles of the invention but are not to be construed as limiting the invention in any way except as indicated by the appended claims.

EXAMPLES

Example 1

No Water Injection

To a steam injector well at the Kern River field in California were injected 450 barrels per day (BPD) of steam of 67 percent quality at 400° F. at the wellhead with a wellhead pressure of 220 psig giving a downhole LVF of 0.005. Added to the steam by pumping at 4 gallons per hour (gph) was a 40 percent aqueous surfactant solution to achieve a 0.5 percent surfactant solution downhole. Also pumped into the steam was 30 standard cubic feet per minute (scfm) of Nitrogen (which is equivalent to 96 cubic feet of Nitrogen per barrel of cold water equivalent steam) to aid in producing foam. Initially, the surfactant was pumped in continuously 24hrs/day for 15 days, then at 12hrs/day for the next 5.5 months. The downhole well pressure increased by 30 psig over baseline during surfactant addition but dropped to near baseline conditions when surfactant stopped. The calculated downhole liquid volume fraction (LVF) at wellhead pressure during surfactant injection was 0.005. After the test ended, a check of reservoir pressure in the injector well showed a decrease of 3 psi, consistent with pressure decreases in all the other injection wells surveyed.

Example 2

Water Injection to Increase LVF

To a steam injector well adjacent to the well in Example 1 above, were injected 630 BPD of steam of 48 percent quality at the wellhead with a wellhead pressure of 130 psig, giving a downhole LVF of 0.0067. Added to the steam by pumping at 6 gallons per hour (gph) was a 40 percent aqueous surfactant solution. Two gallons per minute (gpm) of water was added whenever surfactant solution was pumped in, to achieve a 0.5 percent surfactant solution downhole. Also pumped into the steam was 30 scfm of Nitrogen (which is equivalent to 69 cubic feet of Nitrogen per barrel of cold water equivalent steam) to aid in producing foam. Initially, the surfactant was pumped continuously 24hrs/day for 15 days, then at 12hrs/day for 5.5 months. The wellhead pressure increased by 200 psig during surfactant addition and dropped only slightly when stopped (delta pressure=180). The calculated downhole LVF with water addition even at the 180 psig increase was 0.019 and increased to 0.023 after pressure buildup. After the test ended, a check of the injector well showed a desirable increase in reservoir pressure of 8 psi. This was the only well of 27 wells so surveyed to record a pressure increase. The other wells showed an average reservoir pressure decrease of 3 psi.

Example 3 (comparative)

This example demonstrates the lack of foam formation as measured by pressure buildup when the liquid volume fraction (LVF) of the injected fluid is less than 0.008. Steam of 67 percent quality at 400° F. at the wellhead was injected at the rate of 520 barrels per day (BPD) cold water equivalent (CWE) into a well in the Kern River field in California. To attempt to generate a foam, 4 gallons per hour of 40 percent aqueous surfactant solution and 12 standard cubic feet per minute (scfm) of nitrogen were added to the steam. The concentration of surfactant in the liquid phase of the steam was calculated to be 0.5 percent. The surfactant was pumped in continuously for 15 days and then 12 hours per day for the next 5.5 months. The wellhead pressure showed very little increase over baseline conditions when surfactant flow was stopped, typically less than 40 pounds per square inch (psi) over baseline pressure. The calculated LVF at wellhead pressure was 0.006.

Example 4

Calculation of Liquid Volume Fraction

The liquid volume fraction of injected steam can be calculated according to the following formula:

$$\text{LIQUID VOLUME FRACTION } (LVF) = \frac{\text{VOLUME OF LIQUID}}{\text{VOL. OF LIQUID} + \text{VOL. OF GAS}}$$

$$LVF = \frac{V_s\rho_{cw}(1-q)v_L + V_w}{V_s\rho_{cw}(1-q)v_L + V_w + V_s\rho_{cw}qv_V + V_G}$$

Where:

$V_s$=volume rate of steam on a cold water basis $\rho_{cw}$=density of cold water (350 lb/bbl)

q=steam quality $v_l$=specified saturated volume of liquid water (at given conditions)

$v_v$=specific saturated volume of water vapor (at given conditions)

$v_w$=volume rate of additional water added (at given conditions)

$v_g$=volume rate of gas added (at given conditions)

Sample calculations for both wellhead and downhole liquid volume fractions, where no additional water has been added to the injector well, are shown below.

Sample calculations

At the wellhead $v_s$=200 bbl/d (cold water basis)

q=0.70 p=120 psig t=350° F.

@P=120 psig, T =350° F.:

$v_v$=3.35 $ft^3/lb$ $v_l$=0.0180 $ft^3/lb$ $v_w$=0

$v_g$=979 $ft^3/d$ $$LVF = \frac{(200)(350)(1-0.7)(0.018)+0}{(200)(350)(1-0.7)(0.018)+0+(200)(350)(0.7)(3.35)+979}$$

$LVF$ = 0.0023 AT THE WELLHEAD

Downhole $v_s$=200 bbl/d (cold water basis)

q=0.68 p=121.8 psig t=351.2° F.

@p=121.8 psig, t=351.2° F.

$v_v$=3.31 $ft^3/lb$ $v_l$=0.018 $ft^3/lb$ $v_w$=0

$v_g$=968 $ft^3/d$ $$LVF = \frac{(200)(350)(1-0.68)(0.018)+0}{(200)(350)(1-0.68)(0.018)+0+(200)(350)(0.68)(3.31)+968}$$

$LVF$ = 0.0025 AT BOTTOMHOLE

What is claimed is:

1. A process for the recovery of oil from a petroleum reservoir by improving steam sweep efficiency during steam-flooding, wherein a foaming agent is added to divert steam to unswept zones and the reservoir is penetrated by at least one injection well and at least one production well, which comprises a. injecting steam and a surfactant solution comprising the foaming agent into an injection well, while concurrently and separately injecting an additional amount of liquid water into the injection well to generate a foam and thereby increase the pressure at the injection well; and b. recovering oil from a production well.

2. The process according to claim 1, wherein the steam, surfactant solution and additional amount of water are injected at rates sufficient to achieve a down hole liquid volume fraction greater than 0.008.

3. The process according to claim 1, wherein the additional amount of water is injected at a rate between about 1 and 30 percent of the rate of steam injected, on a cold water equivalent basis.

4. The process according to claim 1, wherein a noncondensable gas is also injected into the injection well in step a.

5. A process for the recovery of oil from a petroleum reservoir by improving steam sweep efficiency during steam-flooding, wherein a foaming agent is added to divert steam to unswept zones and the reservoir is penetrated by at least one injection well and at least one production well, which comprises a. continuously injecting a mixture of steam, noncondensable gas and a surfactant solution comprising the foaming agent, while concurrently and separately injecting an additional amount of liquid water, into an injection well at rates sufficient to achieve a downhole liquid volume fraction greater than 0.008, until an elevated pressure is obtained at the injection wellhead;

b. thereafter continuously injecting steam into the injection well, while slug injecting a noncondensable gas, a surfactant solution comprising the foaming agent, and an additional amount of liquid water at rates sufficient to achieve a liquid volume fraction greater than 0.008, until an elevated pressure is obtained at the injection wellhead; and c. recovering oil from a production well.

6. The process according to claim 5, wherein the noncondensable gas injection rate in step a is from about 35 to 120 standard cubic feet per barrel of cold water equivalent steam injected.

7. The process according to claim 5, wherein the surfactant injection concentration in step a is from about 0.2 to 1.0 weight percent of the liquid phase of injected fluid.

8. The process according to claim 5, wherein the noncondensable gas and surfactant are slug injected in step b at rates ranging from 25 to 100 percent of the rates of injection in step a.

9. The process according to claim 5, wherein the continuous injection of step a is carried out for a period of at least one week.

10. The process according to claim 5, wherein the slug injection of step b is carried out for up to seven consecutive days per week for a period of at least one week.

11. The process according to claim 5, wherein the liquid volume fraction in steps a and b is maintained in the range of about 0.010 to about 0.050.

12. The process according to claim 11, wherein the liquid volume fraction in steps a and b is maintained in the range of about 0.010 to about 0.015.

13. The process according to claim 5, wherein the additional amount of water in both step a and step b is injected at a rate between about 1 and 30 percent of the rate of cold water equivalent steam injected.

* * * * *